United States Patent [19]

Ford

[11] Patent Number: 4,840,414

[45] Date of Patent: Jun. 20, 1989

[54] GREASE FITTING FOR DOG

[76] Inventor: Keith L. Ford, 4327 Woodward, Wayne, Mich. 48189

[21] Appl. No.: 161,953

[22] Filed: Feb. 29, 1988

[51] Int. Cl.[4] ..... E05B 15/02

[52] U.S. Cl. ..... 292/356; 292/241; 292/DIG. 57; 292/DIG. 58; 114/117

[58] Field of Search ..... 292/202, 240, 241, 350, 292/356, 358, DIG. 57, DIG. 58; 114/116, 117, 203; 411/222, 373, 374, 402, 428, 429; 49/395

[56] References Cited

U.S. PATENT DOCUMENTS

| | | | |
|---|---|---|---|
| 549,843 | 11/1895 | Cross | 292/241 |
| 2,060,903 | 11/1936 | Santore | 292/241 |
| 2,062,261 | 11/1936 | Brackett | 114/117 |
| 2,120,039 | 6/1938 | Payne | 292/356 |
| 2,128,305 | 8/1938 | Lambert | 292/241 |
| 2,156,635 | 5/1939 | Mascuch et al. | 114/117 |
| 4,223,799 | 9/1980 | Eyster et al. | 411/429 X |
| 4,685,249 | 8/1987 | Jacox | 292/241 X |

FOREIGN PATENT DOCUMENTS

| | | | |
|---|---|---|---|
| 76587 | 8/1894 | Fed. Rep. of Germany | 411/222 |
| 213617 | 5/1968 | U.S.S.R. | 114/203 |

*Primary Examiner*—Gary L. Smith
*Assistant Examiner*—Douglas E. Ringel
*Attorney, Agent, or Firm*—Charles W. Chandler

[57] ABSTRACT

A dog for latching a watertight door in the bulkhead of a ship, has a lubricant passage with a plug useful for forcing a grease pellet into the passage. The plug extends beyond the end of the spindle for the user to clamp a wrench for removing the plug from the spindle. The dog has two nuts mounted on the end of the spindle. One nut is a conventional nut for fastening the spindle to the bulkhead. The second nut is a cap nut for at least partially enclosing the threaded plug.

5 Claims, 1 Drawing Sheet

GREASE FITTING FOR DOG

BACKGROUND OF THE INVENTION

This invention is related to grease fittings for dogs useful for latching a door or the like to a ship's bulkhead, and more particularly to such a grease fitting having a modified plug in the lubricant passage of the dog's spindle so that the plug can be engaged by a wrench or the like for removal, and a cap nut mounted on the spindle to enclose the spindle end but permitting access to the plug.

Several dogs are commonly employed or latching a door in the bulkhead opening of a vessel. The dog has a handle with a spindle mounted in a bulkhead opening. The end of the spindle extends beyond the bulkhead opening. A pair of nuts lock the spindle in position. The bulkhead opening has an annular cavity for receiving grease through a central passage in the spindle. A grease pellet is inserted into the passage. A threaded plug pushes the pellet through the passage.

One of the problems with such an arrangement is that the threaded plug, when fully seated in the grease passage, exposes only a slot for engaging a screwdriver for removing the plug from the spindle. Frequently, the plug is so frozen in position that it cannot be removed except by a drilling step. This is a time-consuming and expensive process.

SUMMARY OF THE INVENTION

The broad purpose of the present invention is to provide an improved grease fitting for a dog used for latching a door to a bulkhead. For an existing dog, the outermost nut is removed. The plug is also removed and replaced by a longer plug. The longer plug extends beyond the end of a spindle a sufficient distance for the user to engage a wrench. A cap nut is mounted on the end of the spindle and has an opening permitting access to the plug. When a grease pellet is to be inserted into the lubricant passage, the plug is unscrewed, the pellet inserted in the passage and the plug screwed in the spindle to push the grease pellet toward the grease cavity.

If the plug is frozen in position, the user removes the cap nut from the spindle to gain access to the plug, and then clamps a wrench on the plug to remove it from the spindle, without a drilling operation.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
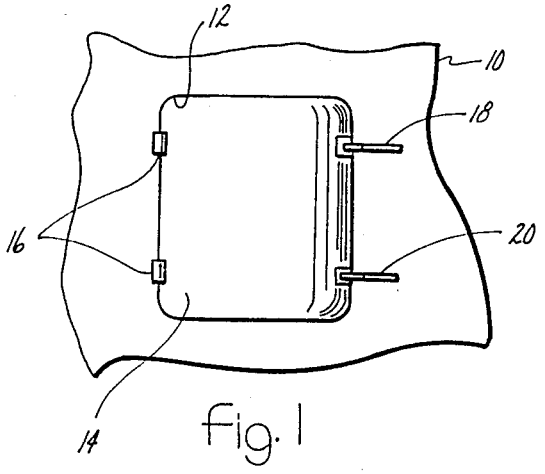
FIG. 1 is a view illustrating a conventional door being latched in a bulkhead opening by a pair of dogs having grease fittings illustrating the preferred embodiment of the invention.
Figure 4:
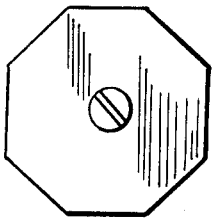
FIG. 4 is view as seen along lines 4—4 of FIG. 3.

Referring to the drawing, FIG. 1 illustrates a ship's bulkhead 10 having an opening 12. Door 14 mounted on hinge means 16 is adapted to be swung in opening 12 between open and closed positions. A pair of latching dogs 18 and 20 are mounted on the bulkhead adjacent the door for locking the door in its closed position. The two dogs are identical to one another.

Figure 2:
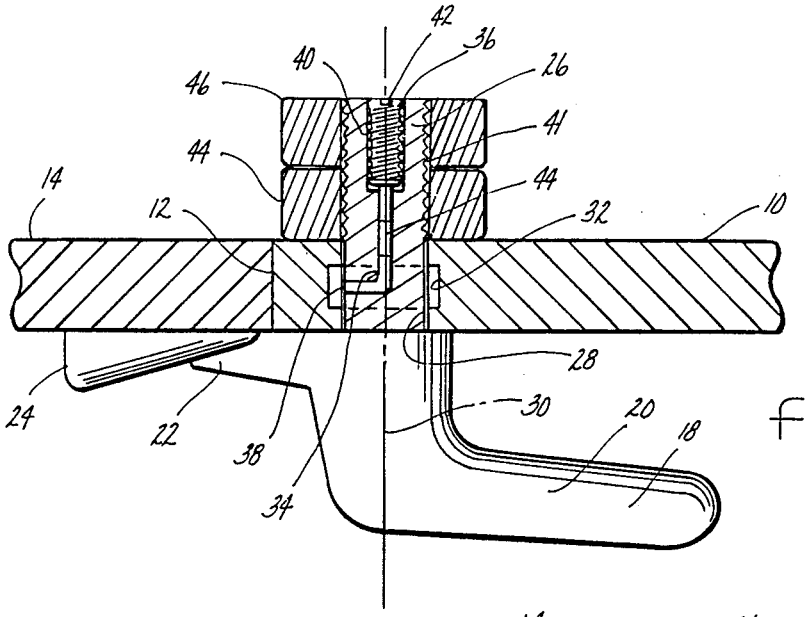
FIG. 2 is an enlarged view illustrating a dog with grease fitting illustrating the prior art.
Figure 3:
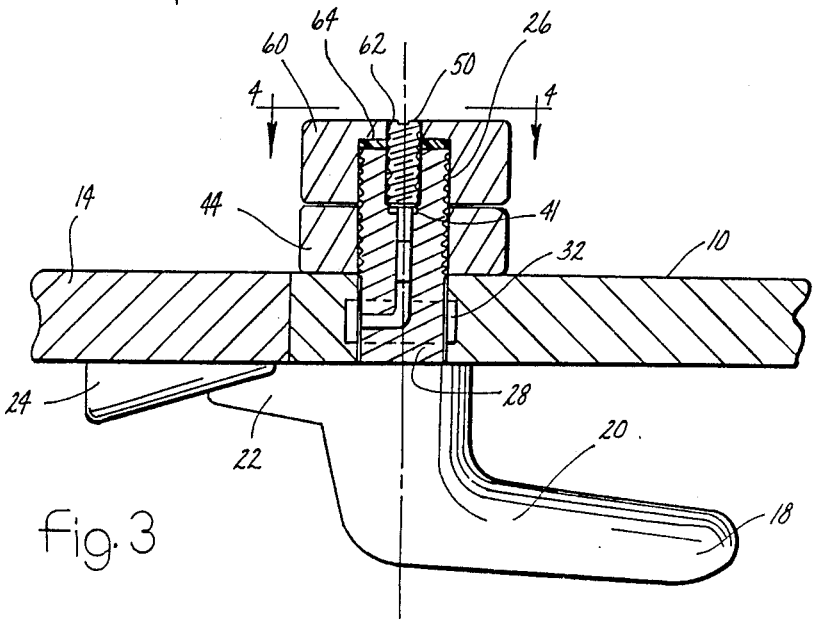
FIG. 3 is an enlarged sectional view illustrating a dog having grease fittings illustrating the preferred embodiment of the invention.

FIG. 2 illustrates the manner in which dog 18 is conventionally mounted to illustrate the prior art. Dog 18 has an elongated handle 20 and a lip 22 which engages a cam plate 24 when the handle is rotated. When the handle is rotated in one direction, the lip engages the cam plate to lock the handle in position. When the handle is rotated in the opposite direction, the lip clears the cam plate so that the door can be opened. The handle carries an externally threaded spindle 26 which is passed through an opening 28 formed about an axis 30. The spindle is slidably rotatable about the axis of the opening.

Opening 28 has an annular grease-receiving cavity 32 disposed about the enclosed portion of the spindle.

The spindle has a lubricant passage 34 for receiving a grease pellet. Passage 34 has an internally threaded inlet opening 36 at the outer end of the spindle, and an outlet opening 38 at the inner end of the spindle, adjacent cavity 32. A threaded plug 40 is mounted in the inlet end of the lubricant passage so as to engage a shoulder 41 when fully seated in passage 34. Plug 40 has a slot 42 for receiving the tip of a screwdriver for rotating the plug to seat it in a position substantially totally within the inlet opening of passage 34. When the spindle is to receive grease into cavity 32, a series of cylindrical pellets of grease 44 are inserted into passage 34. The plug is employed for pushing the pellets through the passage toward cavity 32.

A pair of nuts 45 and 46 are mounted on the threaded end of the spindle to connect it to the bulkhead. The two nuts have a combined thickness corresponding to that portion of the spindle extending beyond the bulkhead so that the outermost nut is substantially flush with the end of the spindle. The end of the plug, when fully seated, is also flush with the end of the spindle.

My invention is useful for either a new grease fitting or for modifying an existing grease fitting by removing plug 40 and nut 46. A new plug 50 is then mounted in the inlet end of the lubricant passage. Plug 50 is larger than original plug 40, and extends beyond the outer end of the spindle. If the plug should become frozen in position, the user can clamp a vice-grip type pliers, not shown, on the plug to remove it.

A cap nut 60 is also mounted on the end of the spindle. Nut 60 has an overall thickness greater than that of original nut 46. Nut 60 has an opening 62 for generally enclosing plug 50. Preferably the cap nut substantially encloses the outer end of the spindle. An annular seal 64 is mounted on the outer end of the spindle so as to be compressed by the cap nut when it is being screwed into position.

The threaded plug is always exposed for removal by a screwdriver so that a grease pellet can be inserted in the lubricant passage. However, should the plug become frozen so that it cannot be removed by a screwdriver, then the user can employ a wrench to remove the cap nut to expose a greater length of the plug. He can then mount a vice-grip type tool on the plug to remove it without the conventional drilling procedure.

Having described my invention, I claim:

1. A dog useful for latching a ship's door to a bulkhead, having an opening communicating with a lubricant-receiving cavity comprising:

a handle having a spindle received through said opening such that a first handle portion is slideably disposed in said opening, the spindle having external threaded means and a lubricant passage with an inlet opening in an extreme end of the spindle, and an outlet opening adjacent the lubricant-receiving cavity;

the inlet opening of the lubricant passage having internal threaded means;

an elongated plug threadably received in the inlet opening, and abutment means in the spindle engageable with the plug such that when fully seated in the spindle inlet opening, the outer end of the plug extends beyond the spindle a sufficient distance for a tool to clampingly engage the plug;

a first nut mounted on the external, threaded means of the spindle so as to abut the bulkhead on the side opposite the handle; and a cap nut mounted on the spindle adjacent the first nut to substantially enclose the end of the spindle, the cap nut having an opening for generally enclosing the outer end of the plug.

2. A combination as defined in claim 1, including an annular seal disposed on the end of the spindle around the plug so as to be compressed between the interior of the cap and the spindle end.

3. A combination as defined in claim 1, in which the plug is adapted to urge a grease pellet into the lubricant passage.

4. A combination as defined in claim 1, in which the bulkhead opening is formed about an axis, and the handle and spindle are rotatable about the axis of said opening.

5. A method for improving a grease fitting for a dog rotatable in an opening in a bulkhead, the dog having a spindle extending through said opening, first and second nuts mounted on the spindle on the side opposite the handle, and including a threaded plug mounted in a grease passage in the spindle, comprising the steps of:

removing the outermost of said nuts;

replacing the plug with a longer plug having a length such that a substantial portion thereof extends beyond the end of the spindle for engagement by a tool for rotating the plug; and then mounting a cap nut having an opening for receiving the plug therethrough on the end of the spindle so as to generally enclose the end of the spindle and the plug.

* * * * *